United States Patent [19]

Nonoyama et al.

[11] Patent Number: 5,030,973

[45] Date of Patent: Jul. 9, 1991

[54] PRESSURE DAMPER OF AN INK JET PRINTER

[75] Inventors: Shigeo Nonoyama, Kawasaki; Mitsuo Ozaki; Noboru Takada, both of Atsugi; Tsuneo Mizuno, Yokohama; Akira Nakazawa, Isehara, all of Japan

[73] Assignee: Fujitsu Limited, Kawasaki, Japan

[21] Appl. No.: 480,194

[22] Filed: Feb. 14, 1990

[30] Foreign Application Priority Data

| | | | |
|---|---|---|---|
| Feb. 17, 1989 | [JP] | Japan | 1-036322 |
| Sep. 20, 1989 | [JP] | Japan | 1-241843 |
| Sep. 20, 1989 | [JP] | Japan | 1-241844 |

[51] Int. Cl.[5] ..... B41J 2/17

[52] U.S. Cl. ..... 346/140 R

[58] Field of Search ..... 346/140

[56] References Cited

U.S. PATENT DOCUMENTS

| | | | |
|---|---|---|---|
| 4,126,868 | 11/1978 | Kirner | 346/140 |
| 4,263,602 | 4/1981 | Matsumoto | 346/140 |
| 4,347,524 | 8/1982 | Engel et al. | 346/140 R |
| 4,475,116 | 10/1984 | Sicking | 346/140 |

FOREIGN PATENT DOCUMENTS

| | | |
|---|---|---|
| 3247419 | 6/1984 | Fed. Rep. of Germany . |
| 3424244 | 1/1986 | Fed. Rep. of Germany . |
| 3525810 | 1/1987 | Fed. Rep. of Germany . |
| 3621193 | 1/1987 | Fed. Rep. of Germany . |
| 17056 | 1/1988 | Japan . |

*Primary Examiner*—Joseph W. Hartary

*Attorney, Agent, or Firm*—Armstrong, Nikaido, Marmelstein, Kubovcik & Murray

[57] ABSTRACT

A pressure damper of an ink jet printer provided in an ink feed line between an ink jet head and an ink tank to absorb a pressure fluctuation in the ink feed line, wherein the pressure damper has a damper body provided with a pressure absorbing chamber and a filter incorporated therein to filter the ink.

16 Claims, 11 Drawing Sheets

| CONDITIONS | | PRESSURE FLUCTUATION | VARIATION (IRIS) |
|---|---|---|---|
| WITHOUT PRESSURE DAMPER | | (A)  | +120mmH2O ~-46mmH2O (+48mmH2O ~-22mmH2O) |
| WITH PRESSURE DUMPER | FULL FILLING  | (B)  | +25mmH2O ~-10mmH2O (+24mmH2O ~-22mmH2O) |
| | PARTIAL FILLING  | (C)  | +38mmH2O ~-23mmH2O |

H: 50mmH2O/div
V: 0.2sec/div

PRESSURE DAMPER OF AN INK JET PRINTER

BACKGROUND OF THE INVENTION

1. Field of the Invention

The present invention relates to a pressure damper of an ink jet printer, and provided between an ink jet head and an ink feed source to absorb a pressure fluctuation of an ink to be fed to the ink jet head.

2. Description of the Related Art

FIG. 12 shows a known typical ink jet printer in which an ink tank (cartridge) 2, which contains a vacuum-degassed liquid ink, is connected by an ink feed tube 8 to an ink jet head 4 carried by a head carriage 6. The ink jet head 4 has jet nozzles 4*b* (FIG. 13) from which an ejection of ink onto a recording medium (paper etc.) 10 is controlled by a control unit (not shown). The head carriage 6, which supports the ink jet head 4, is moved by the control unit along guide bars 7*a* and 7*b* in the opposite directions shown by an arrow, and upon printing, the jet nozzles 4*b* are moved closer to a platen 12. The ink jet head 4 is provided therein with pressure chambers 4*c* (FIG. 13) corresponding to the nozzles 4*b*, and piezoelectric elements 4*d* (FIG. 13) opposed to the pressure chambers 4*c*, so that the volume of the pressure chambers 4*c* can be reduced by the associated piezoelectric elements 4*d* at a predetermined time sequence and in a predetermined pattern, to eject the ink from the associated jet nozzles connected to the pressure chambers 4*c* to thereby perform the printing on the recording paper 10, which is than moved upward by the platen 12.

In the kind of serial type ink jet printer mentioned above, during the reciprocal movement (forward movement and return movement) of the ink jet head 4, an acceleration force is applied to the ink jet head or to the ink itself in the ink passages in the ink jet head, and a pressure change occurs in the ink due to the inertia thereof, thus resulting in a failure to provide a stable ejection of ink from the jet nozzles 4*b*. Namely, when the pressure in the pressure chambers 4*c* is reduced by the associated piezoelectric elements 4*d*, the increased pressure due to the pressure reduction of the pressure chambers is absorbed by air bubbles, and thus the increased pressure can not be effectively transmitted to the ink, and accordingly, an ejection of ink from the jet nozzles cannot be obtained.

To reduce the effect of the pressure change, a pressure damper is usually provided in the ink feed line.

Furthermore, for example, upon an exchange of the ink tank (cartridge), foreign matter, such as fine particles or air bubbles, may enter the ink feed line, resulting in a blocking or plugging of the jet nozzles, and this is prevented by a mesh filter provided in the ink feed line.

When an irregular ejection of ink occurs in the ink jet head, purging is carried out to pressurize or exert a suction force on the ink in the ink line, to thereby force the foreign matter out of the plugged nozzles.

FIG. 13, 14, and 15 show a known pressure damper 16 usually provided in the ink feed tube 8 between the ink tank 2 and the ink jet head 4, as shown in FIG. 12.

As can be seen in FIGS. 14 and 15, the pressure damper 16 has a plate-like main body 20 made of polyethylene and provided with holes and channels on the opposite side faces thereof which are closed by flexible films 22 and 24 secured to the opposite side faces of the main body 20, so that the channels define an ink passage and the holes define a pressure absorber. Namely, the side faces 20*a* and 20*b* of the main body 20 are provided at the central portions thereof with pressure absorbing portions 26*a* and 26*b* (pressure absorbing chamber 26) which are defined by circular recesses interconnected by a connecting hole 28. An ink inlet plug portion 27 to which the ink feed tube is inserted is formed in the vicinity of the upper end of the main body 20. The ink inlet passage 22, which is defined by the channel formed in the main body 20, is formed in one side 20*a* of the main body 20 to be connected to an inlet port 25 of the inlet plug portion 27. The ink inlet passage 22 is also connected to the first pressure absorbing portion 26*a*.

Similarly, an ink outlet plug portion 31 is formed on the opposite side of the main body 20 to the ink inlet plug portion 27, in which the ink feed tube 8 is inserted. An ink outlet port 33 of the ink outlet plug portion 31 is connected to an ink outlet passage 35, which is defined by the channel formed in the main body 50, and the ink outlet passage 35 is connected to the first pressure absorbing portion 26*a*.

The pressure fluctuation of the ink is absorbed by elastic deformations (vibration) of the flexible films 22 and 24 on the opposite sides of the main body 20. The ink feed tube 8*a* (FIG. 13) between the ink tank 2 and the pressure damper 16 is connected at one end thereof to an ink feed port 2*a* of the ink tank 2. The ink feed tube 8*b* between the pressure damper 16 and the ink jet head 4 is connected at one end thereof to a common ink chamber 4*a* of the ink jet head 4 and at the opposite end to the ink outlet port 33 of the ink outlet plug portion 31 of the pressure damper 16.

The mesh filter 17 is provided upstream of the pressure damper 16, to trap foreign matter such as relatively large air bubbles or fine particles.

As can be understood from the foregoing, in the prior art shown in FIGS. 13 to 15, the pressure fluctuation of the ink is absorbed by the pressure damper 16 and the foreign matter is caught by the mesh filter 17, so that almost no foreign matter enters the pressure damper 16. The pressure damper 16, however, is a separate unit from the mesh filter 17, thus resulting in an increased size of the apparatus. Furthermore, fine air bubbles not trapped by the mesh filter 17 enter the pressure damper 16 and collect in the upper portion of the pressure absorbing portions 26*a* and 26*b*, as shown at 18 in FIG. 13. To eliminate these air bubbles 18, the above purging is carried out. The purge device 23, which includes a purge pump 29 and a purge sucker 30 connected thereto as shown in FIG. 13, is usually provided outside the printing area. When the purging is effected, the ink jet head 4 is automatically moved in front of the purge device 23 by a drive (not shown), so that the nozzles 4*b* are opposed to the purge sucker 30. The subject of the present invention is not directed to the purge, which is per se known, and accordingly, a detailed description thereof is not given herein.

During the purge, the air bubbles 18 in the pressure damper 16 are sucked through the ink outlet passage 35 of the pressure damper 16, but the relatively large bubbles trapped by the mesh filter 17 can not pass through the mesh filter 17, because of an interfacial force of the ink, and thus the bubbles together with the fine particles remain trapped by the mesh filter 17. Accordingly, the effective filtering opening area is often reduced after a long time use thereof. To prevent this reduction of the area, it is necessary to use a large size of mesh filter, resulting in an increased size of the apparatus.

SUMMARY OF THE INVENTION

The primary object of the present invention is to provide a pressure damper of an ink jet printer in an ink feed line between an ink jet head and an ink tank, to absorb a pressure fluctuation in the ink feed line, wherein said pressure damper comprises a damper body including a pressure absorbing chamber and a filter for filtering the ink.

According to one aspect of the invention, the filter is provided in the ink feed line downstream of the pressure absorbing chamber, and according to another aspect of the invention, the filter is provided in the pressure absorbing chamber.

With this arrangement, the filter is integrally incorporated in the pressure damper, and accordingly, a small pressure damper having a reliable filtering function can be realized, thus resulting in a realization of a small and compact ink jet printer and a stable ink feed.

Also, according to the construction mentioned above, the bubbles trapped by the mesh filter are collected, so that when the bubbles become a certain size and form a big bubble, the latter is separated from the mesh filter and floated under its own buoyancy. Since the mesh filter is provided in the ink passage downstream of the pressure absorbing chamber, the floated bubble can be trapped by the pressure absorbing chamber of the pressure damper, and therefore, no blocking of the mesh filter occurs, and accordingly, it is not necessary to provide a large filter to ensure a sufficient opening area to contract such blocking.

BRIEF DESCRIPTION OF THE DRAWINGS

The invention will be described below in detail with reference to the accompanying drawings, in which.

DESCRIPTION OF THE PREFERRED EMBODIMENTS

FIG. 1 through 5 show a first embodiment of a pressure damper of an ink jet printer, according to the present invention.

Figure 2:
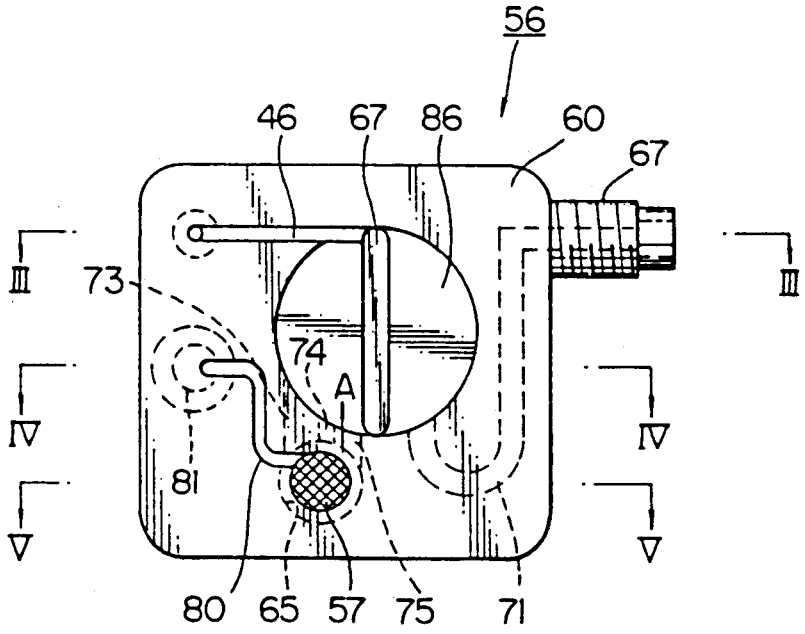
FIG. 2 is a plan view of a pressure damper shown in FIG. 1, with the upper cover (flexible film) removed.
Figure 3:
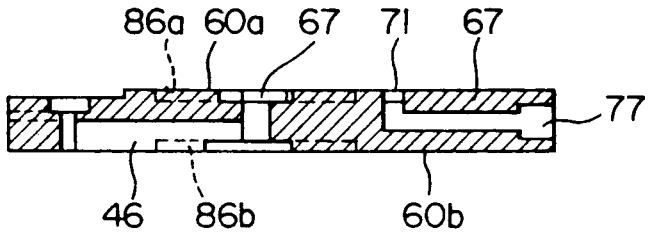
FIGS. 3, 4 and 5 are sectional views taken along the lines III—III, IV—IV, and V—V in FIG. 2.
Figure 4:
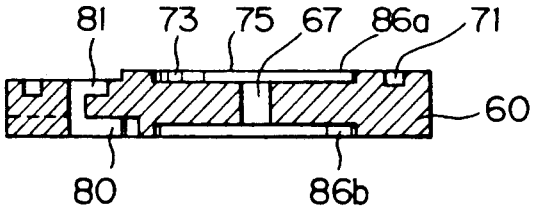
Figure 12:
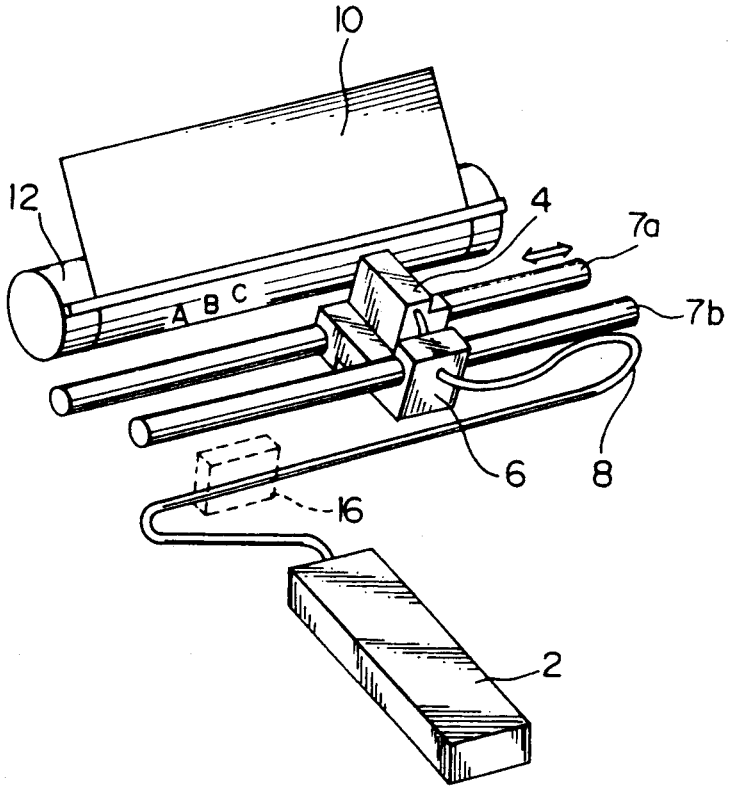
FIG. 12 is a perspective view of a known typical ink jet printer to which the present invention can be applied.

In the illustrated embodiment, a pressure damper 56 is provided on the ink jet head 4 or the ink head carriage 6 (FIG. 12) in the ink line between the ink jet head 4 and the ink tank 2. The pressure damper 56 is provided with a pressure absorbing chamber 86 (corresponding to the pressure absorbing chamber 26 in FIG. 13) having an ink inlet passage 62 (corresponding to the ink inlet passage 22 in FIG. 13) and outlet passage 65 (corresponding to the ink outlet passage 35 in FIG. 13) connected thereto. The mesh filter 57 is provided in the portion 87 of the ink outlet passage 65 directly below (downstream of) the pressure absorbing chamber 86, to filter the ink. The mesh filter 57 is located such that, when the air bubbles trapped by the mesh filter 57 separate therefrom, all of the air bubbles enter the pressure absorbing chamber 86. The pressure absorbing chamber 86 has a larger volume than the ink passage. As shown in FIG. 2 to 5, the pressure damper 56 has a plate-like main body 60 made of an injection molded polyethylene and having channels and holes forming an ink passage. The main body 60 is provided on opposite sides thereof with flexible films (air and moisture impermeable membranes) 64 and 66 (not shown in FIGS. 3 and 4, for clarification, and shown in only FIG. 5 with an exaggerated thickness) adhered thereto, so that the channels and holes define ink passages. Namely, the main body 60 is provided, on center portions or in the vicinity thereof of the opposite side faces **60*a* and 60*b*, with circular recesses 86*a* and 86*b* which define the first and second pressure absorbing portions interconnected by a connecting hole 67. The connecting hole 67 is preferably in the form of an elongated slit having a length substantially equal to the diameter of the circular recesses 86*a* and 86*b*, as shown in FIG. 2. Consequently, the air bubbles are trapped by the mesh filter 57 on the upper side 57*a* of the mesh filter 57, and accordingly, the air bubbles enter only the first pressure absorbing portion 86*a*. Namely, bubbles do not enter the second pressure absorbing portion 86*b* having a bubble discharge passage 46 (FIGS. 2 and 3) connected thereto and connected to a bubble discharge tube 49. The main body 60 has at the upper end thereof an ink inlet plug portion 67 to which an ink feed tube 8 (FIG. 12) can be inserted, as shown in FIGS. 2 and 3. On the first side face 60*a* of the main body 60 is formed a channeled ink inlet passage 71 connected to the inlet port 77 of the ink inlet plug portion 67 and to the first pressure absorbing portion 86*a***.

On the first side face **60*a* of the main body 60 are formed two connecting passages 73 and 75 connected to the first pressure absorbing chamber 86*a* and spaced from one another by a bank 74 (FIG. 2). The mesh filter 57 is mounted to a stepped portion 89 of the ink outlet passage 65 by an annular member 88. Alternatively, the mesh filter 57 can be adhered to the damper body 60 by an appropriate adhesive and the annular member omitted. The ink outlet passage 65 is connected to a channeled ink outlet passage 80 formed on the second side face 60b of the main body 60 and connected to an ink outlet port 81 opening into the first side face 60a of the main body 60**.

The ink outlet port 81 is connected to the common ink chamber 4a of the ink feed tube 8b. Note that the ink feed tube 8b is short, and thus almost no displacement thereof takes place when the head carriage is moved during printing.

The bubble discharge passage 46 formed on the second side face 60b of the main body 60 is connected to the second pressure absorbing portion 86b and to one end (upper end in FIG. 2) of the connecting hole 67, to discharge the bubbles in the course of purging. The bubble discharge passage 46 is also connected to a dummy nozzle 4b' provided in the ink jet head 4 through a bubble discharge tube 49, as can be seen in FIG. 1.

The flexible films 66 and 64 are adhered to the first and second side faces 60a and 60b of the main body 60 to form closed ink passages 71 and 80 and a closed pressure absorbing chamber.

Figure 1:
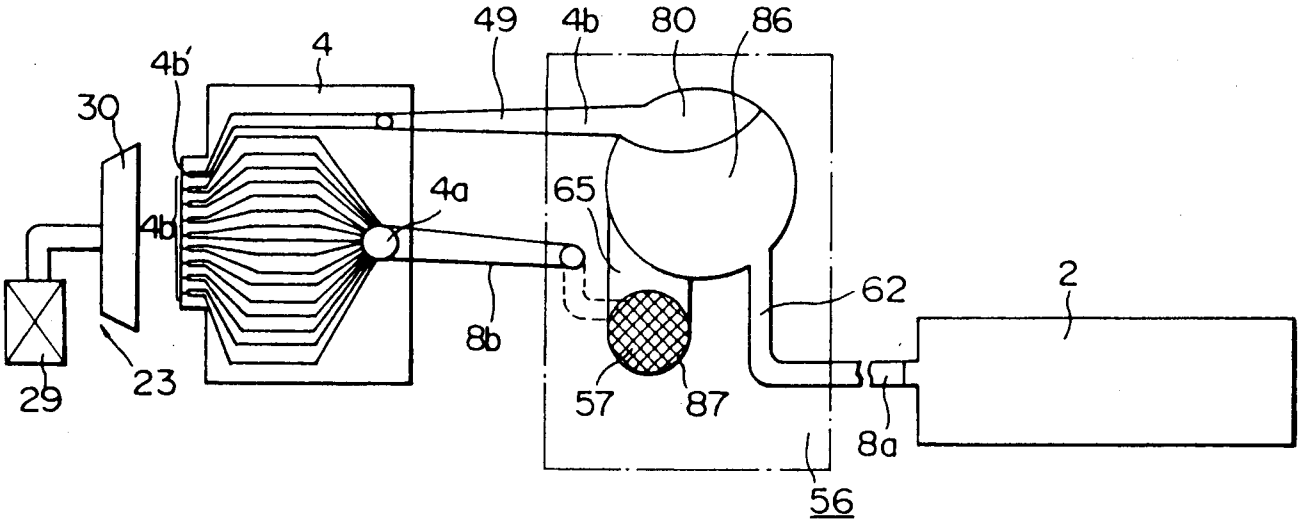
FIG. 1 is a schematic view of a pressure damper according to an aspect of the present invention.

The pressure damper as constructed above is provided, for example, in the ink head carriage 6 between the ink tank 2 and the ink jet head 4, in such a way that the mesh filter 57 is located below the pressure absorbing chamber 86 so as to effectively absorb the pressure fluctuation and to filter the ink, as shown in FIG. 1.

The pressure damper as constructed above according to an aspect of the present invention operates as follows.

The ink fed by the ink tank 2 is introduced into the pressure chamber 86 through the ink inlet passage 71, and pressure fluctuations of the ink are absorbed by the vibration (elastic deformation) of the flexible films 64 and 66.

Air bubbles having a certain size or larger and contained in the ink float due to a buoyancy thereof and are collected in the upper portion of the pressure absorbing chamber 86.

Figure 13:
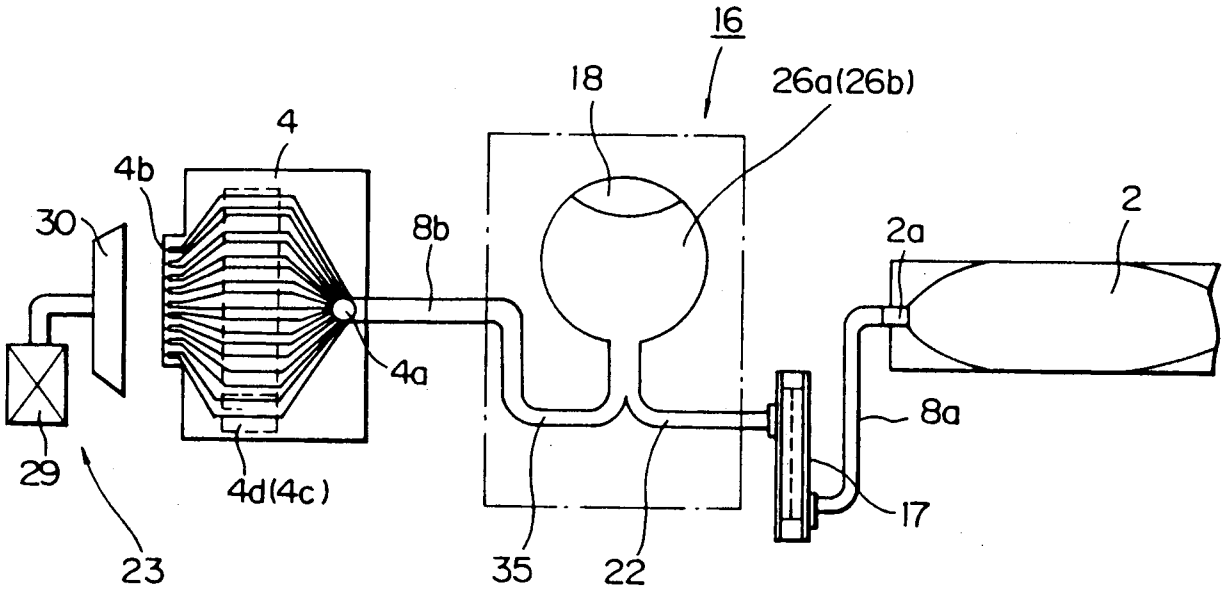
Fig.13 PRIOR ART
FIG. 13 is a schematic view of a known ink jet printer.
Figure 14:
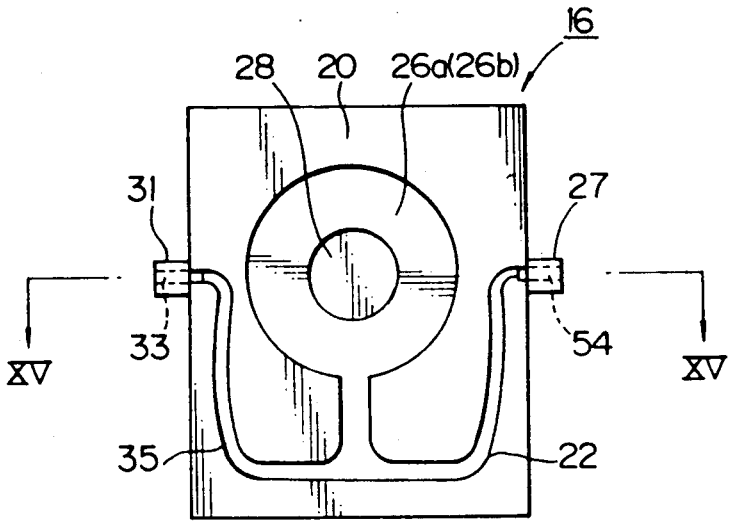
Fig.14 PRIOR ART
FIG. 14 is a schematic plan view of a known pressure damper, with the flexible film removed.

When the ink passes through the mesh filter 57 into the ink outlet passage 80, the fine particles or relatively small bubbles contained in the ink are trapped by the mesh filter 57. As soon as the trapped bubbles become a certain size, the bubble is separated from the mesh filter 57 by its own buoyancy. The certain size of bubbles collected in the upper portion of the pressure absorbing portion 86a moves in the direction A in FIG. 2, under its own buoyancy, so that the bubble is brought into the upper portion of the pressure absorbing portion 86a through the connecting straight passages 73 and 75 not having a stepped portion. Consequently, the certain size of bubble is merged with the first mentioned bubbles already brought to the upper portion of the pressure absorbing portion 86a. The bubbles collected in the upper portion of the pressure absorbing portion 86a can be sucked and discharged therefrom by the purge device 23 at certain predetermined intervals, which are experimentally determined, or at every predetermined number of drive pulses of all of the piezoelectric elements 4d (FIG. 13). Namely, upon purging, the purge device 23 having the purge pump 29 and the sucker (or aspirator) 30 is moved to the front to the ink jet nozzles 4b, so that the sucker 30 is attached to the ink jet nozzles 4b and the dummy nozzle 4b' to cover the same. When the purge pump 29 is actuated, the air bubbles collected in the upper portion (space) of the pressure absorbing chamber 86 are sucked and discharged therefrom through the bubble discharge passage 46, the bubble discharge tube 49, and the dummy nozzle 4b'.

It is obvious from the above that, during purging, the bubbles which pass through the mesh filter 57 and remain in the ink jet nozzles 4, and the ink in the ink jet nozzles 4b, are sucked and discharged by the purge device 23.

The mesh filter 57 can be made, for example, of woven stainless steel wires having a filter bore of about 25 μm.

As can be understood from the above, according to the present invention, since no blocking of the mesh filter occurs, there is no reduction of the effective opening area of the filter, whereby a smaller mesh filter can be used, and accordingly, the pressure damper can be easily incorporated in the apparatus in the present invention. Furthermore, there is no occurrence of cavitation because of no bubbles exist in the ink line between the ink tank and the ink jet head, due to the periodical purging.

Even if initially there is no ink in the ink line, an ink line can be easily filled with the ink without causing bubbles, by a first purging after the ink tank is attached, and accordingly, packaging and transportation of the products (ink jet printers) without ink solves several inherent problems, such as a leakage of ink, etc.

In the illustrated embodiment, although the ink jet head is separate from the pressure damper, which is connected thereto by the ink feed tube, it is possible to integrally form them of laminated plates.

Figure 6:
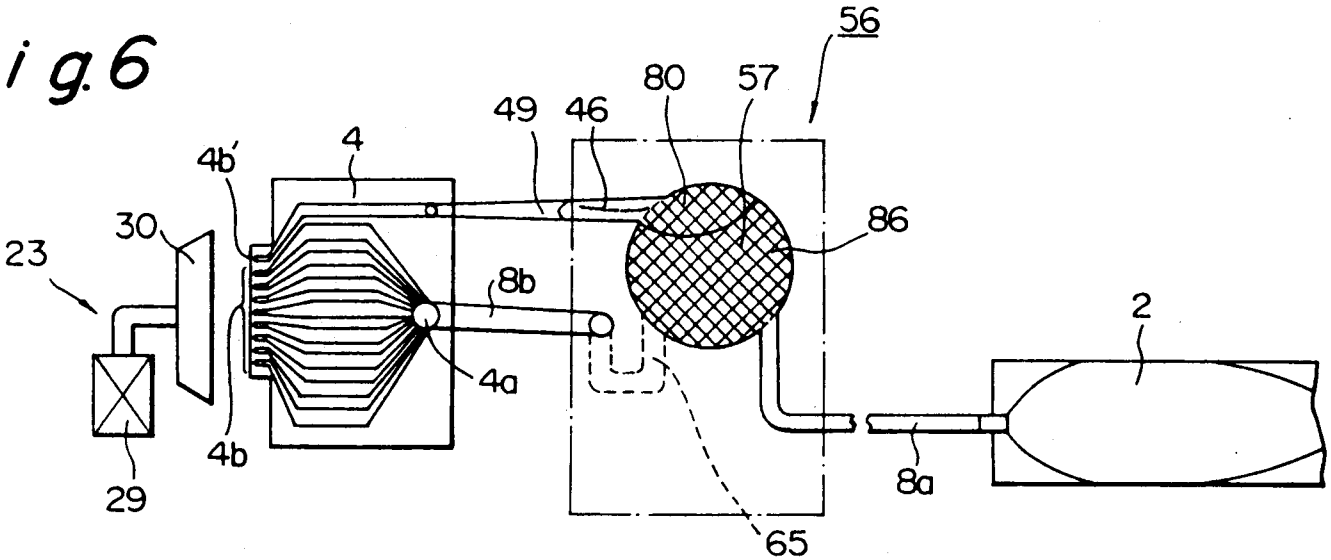
FIG. 6 is a schematic view of an ink jet printer having a damper shown in FIG. 1.
Figure 7:
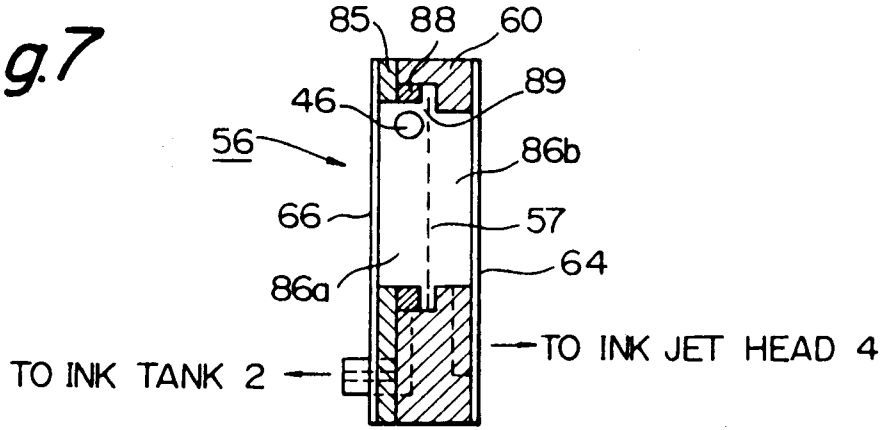
FIG. 7 is a sectional view of a main part of a pressure damper according to another aspect of the present invention.

FIGS. 6 and 7 show another embodiment of the present invention in which the mesh filter 57 is provided in the pressure absorbing chamber 86, i.e., between the first and second pressure absorbing portions 86a, and 86b. Except for the location of the mesh filter 57 in the pressure chamber 86, the second embodiment shown in FIGS. 6 and 7 is substantially the same as the first mentioned embodiment. As can be seen in FIG. 7, the mesh filter 57 is pressed against and secured to a stepped portion 89 of the main body 60, which is made of, for example, polyethylene, by an annular elastic member 88. The annular elastic member 88 is pressed against the damper body 60 by a securing plate 85, which is made of, for example, polyethylene. The flexible film 64 (diaphragm) is secured to the damper body 60 and the flexible film 66 (diaphragm) is adhered to the securing plate 85, respectively, and the securing plate 85 and the damper body 60 are made an integral unit by securing the same with, for example, screws (not shown):

The bubble discharge passage 46 opening into the upper portion of the pressure absorbing portion 86a provided on the ink tank side is connected to the dummy nozzle 4b' through the bubble discharge tube 49, similar to the first embodiment shown in FIG. 1.

In this alternative embodiment shown in FIGS. 6 and 7, since the mesh filter 57 is provided in the pressure absorbing chamber 86, which has a larger cross section area than that of the ink outlet passage 87 in the first embodiment shown in FIG. 1, the fine particles trapped by the mesh filter 57 have less influence on the smooth flow of the ink. Furthermore, since the time for which the bubbles remain in the ink passage on the upstream side of the mesh filter becomes shorter than that in the first embodiment, the likelihood of a mergence of the bubbles with the ink is greatly reduced, and thus a least possibility exists of a failure of an ejection of the ink from the jet nozzle 4b due to cavitation.

Figure 5:
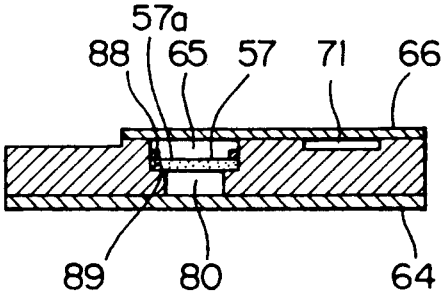
Figure 8A:
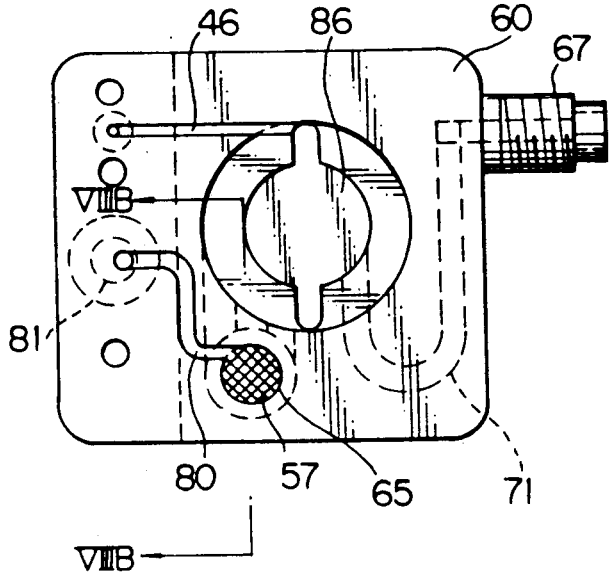
FIG. 8A is a plan view of a pressure damper similar to FIG. 2, but according to another aspect of the present invention as shown in FIG. 7.
Figure 8B:
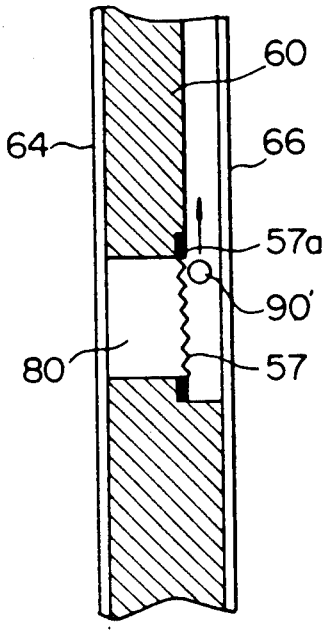
FIG. 8B is a sectional view taken along the line VIII—VIIIV in FIG. 8A.
Figure 9:
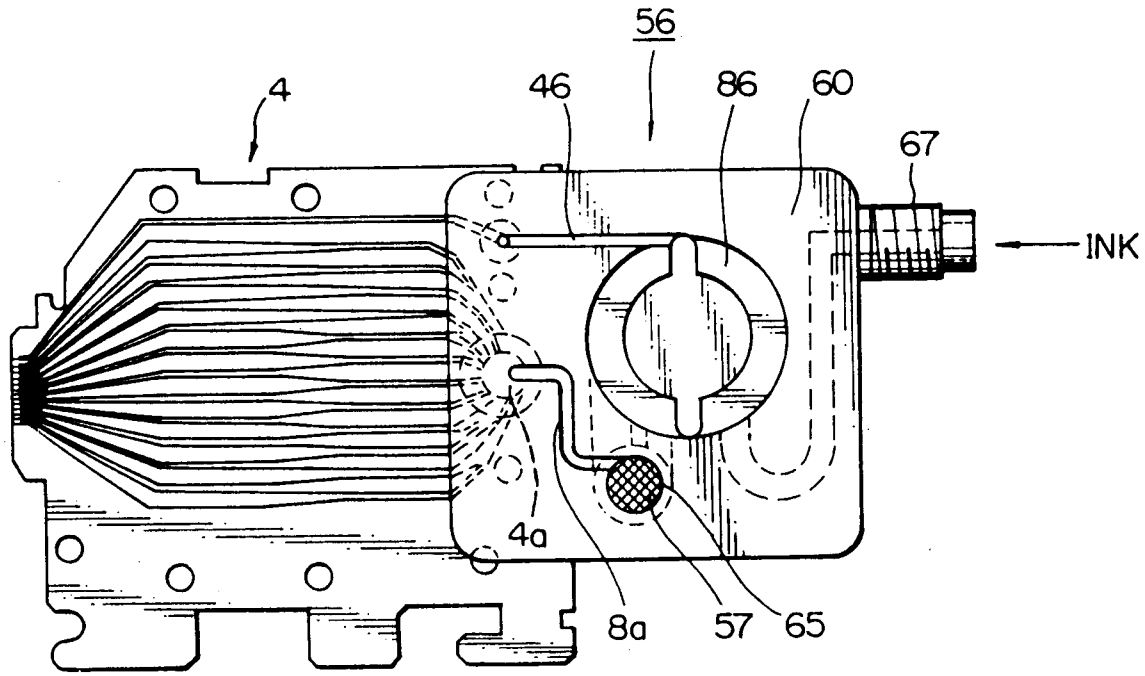
FIG. 9 is a schematic view of main part of an ink jet printer having a pressure damper shown in FIGS. 8A and 8B.
Figure 16:
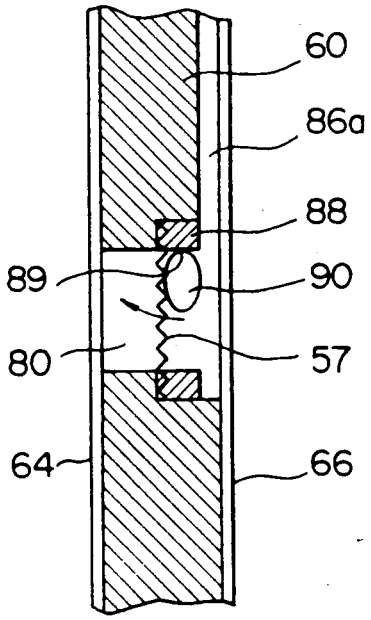
Fig.16 PRIOR ART
Figure 15:
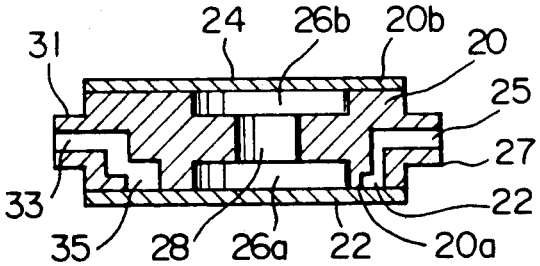
Fig.15 PRIOR ART
FIG. 15 is a sectional view of a pressure damper, taken the line XV—XV in FIG. 14; and, FIG. 16 is a sectional view of a known pressure chamber, explaining how air bubbles remain in the vicinity of a mesh filter.

FIG. 8A, 8B and 9 shown a third embodiment of the present invention, in which the improvement is directed to how to secure the mesh filter 57 to the damper body 60. FIG. 8A shows a modification of the arrangement shown in FIG. 2. In the arrangement of the above-mentioned embodiments, as can be seen in FIGS. 5 and 7, since the mesh filter 57 is mounted to the stepped portion 89 of the damper body 60 by the annular member 88, as mentioned before, the stepped portion 89 causes the bubbles 90 (FIG. 16) to tend to remain in the vicinity thereof. This tendency is shown in FIG. 16.

In the arrangement shown in FIGS. 8A, 8B and 9, the mesh filter 57 is secured to the damper body 60, more precisely, to the ink outlet passage 80, by, for example, a heat seal, such as a thermal deposition or the like, without using the annular member 88 shown in FIGS. 5 and 7. To this end, at least one of the damper body 60 and the mesh filter 57 is made of a resin material which can be thermally melted to be integrally connected to the other. Preferably, both of the damper body 60 and the mesh filter 57 are made of a thermally meltable resin (e.g., polyethylene, polypropylene or nylon-66 etc.) stable against chemical substances, such as an ink. Upon securing, a trowel (not shown) which has been heated to about 200° C. is brought into press contact with the circumferential portion 57*a* of the circular mesh filter 57 located on the damper body 60 to surround the ink outlet passage 80, so that the circumferential portion 57*a* and the corresponding portion of the damper body 60 are melted and integrated with each other. Thus, a keep member such as the annular member 88 can be dispensed with in the present invention, and this enables the mesh filter 57 to be made substantially flush with the surface of the damper body in the vicinity of the mesh filter as shown in FIG. 8B, thus eliminating the tendency of the bubbles to remain in the vicinity of the periphery of the mesh filter 57.

The mesh filter 57, which is made of woven stainless steel wires, can be replaced by a filter having a large number of bores formed by etching.

It is also possible to melt the damper body and/or the filter which is made of resin or synthetic fiber stable against the ink, by using an organic solvent which dissolves the resin.

There is no limitation to the material of which the damper body and the filter are made, so long as the damper body and the filter can be melted and adhered to each other by, for example, heat or a solvent.

The absence of an adhesive eliminates the possibility of a mergence of the adhesive with the ink and a separation of the filter from the damper body.

In the arrangement shown in FIG. 9, the pressure damper 56 is made integral with the ink jet head 4.

FIG. 10A-10E shows a fourth embodiment of the present invention, in which a bypass passage 95 is provided between the pressure absorbing chamber 86 and the ink outlet passage in which the mesh filter 57 is provided.

FIG. 10A-10E also successively show how the pressure damper is filled with an ink when the ink is fed thereto from the ink tank 2. Note that the arrangement of FIGS. 10A-10E is inverse to those of FIGS. 2, 6 and 8A, etc.

Figure 10A:
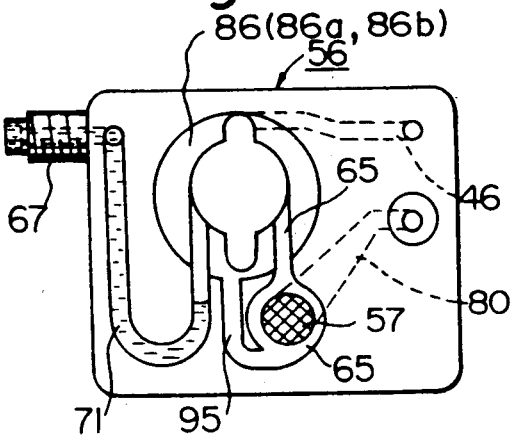
FIG. 10A through 10E are schematic plan views of a pressure damper and showing how an ink line is successively filled with an ink, according to still another aspect of the present invention.
Figure 10B:
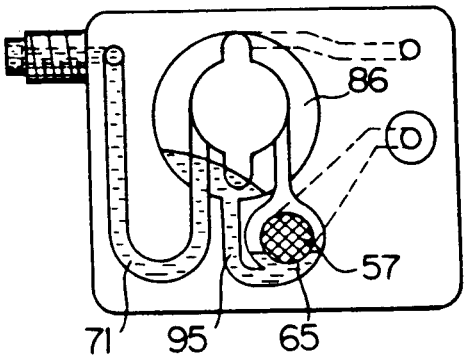
Figure 10C:
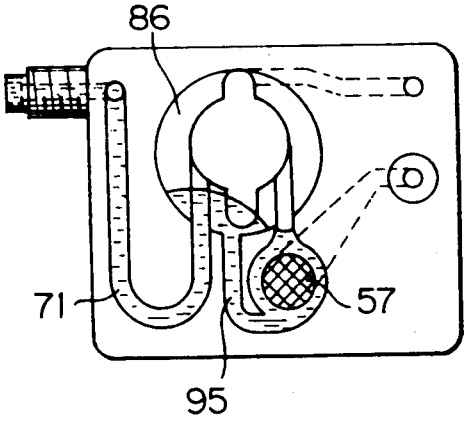
Figure 10D:
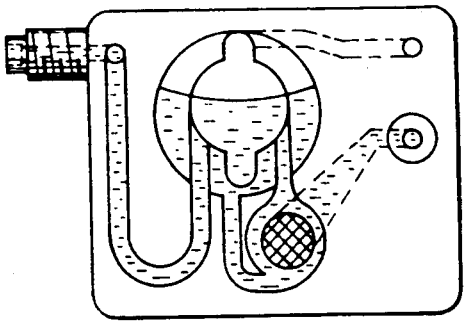
Figure 10E:
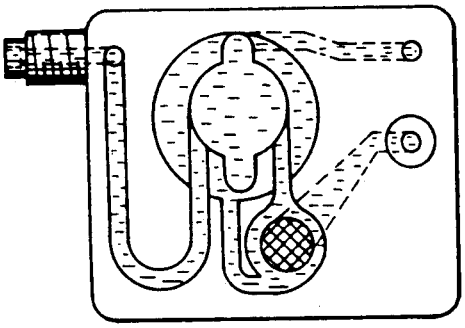

In the modified embodiment shown in FIGS. 10A-10E, the bypass passage 95 connects the ink outlet passage portion 65 (FIG. 2) below the mesh filter 57 and the bottom of the pressure absorbing chamber 86 (e.g. the first pressure absorbing portion 86*a*). As is well known, when the ink tank 2 is attached to the ink feed tube 8*a* (FIG. 2), an outlet port (not shown) of the ink tank 2 is broken by a piercing needle (not shown) formed at the front end of the ink tube, so that the inside of the ink tank 2 communicates with the ink feed tube 8*a*. As a result, the ink in the ink tank 2 is sucked by the vacuum of the ink jet head 4 into the pressure damper 56 through the ink feed tube 8*a*. First, the ink enters the ink inlet passage 71 (FIG. 10A) and then comes into the pressure absorbing portion 86*a*. As soon as the ink enters the pressure absorbing portion 86*a*, the ink flows into the ink outlet passage 65 from the bottom thereof though the bypass passage 95, as shown in FIG. 10B. Thereafter, the outlet passage 65 including the mesh filter 57 is filled with ink (FIG. 10C). Then the ink enters the pressure absorbing chamber 86 (the first and second pressure absorbing portions 86*a* and 86*b*) from the bottom thereof, as shown in FIG. 10D, and finally, the ink spreads over the ink line in the pressure damper, as shown in FIG. 10E.

If there is no bypass passage, the ink outlet passage is filled with an ink from above, i.e., from the pressure absorbing chamber 86, so that the air existing in the pressure absorbing chamber 86 and in the ink outlet passage tends to remain as a bubble in the bottom of the ink outlet passage. The bypass passage 95 contributes to an elimination of such a bubble, since the ink enters the ink outlet passage from the bottom thereof while moving the air upward, and as a result, air existing in the pressure absorbing chamber 86 and in the ink outlet passage is finally forced out through the bubble discharge passage 46 and the bubble discharge tube 49, and thus bubbles cannot remain in the pressure absorbing chamber 86 and the ink outlet passage.

Figure 11:
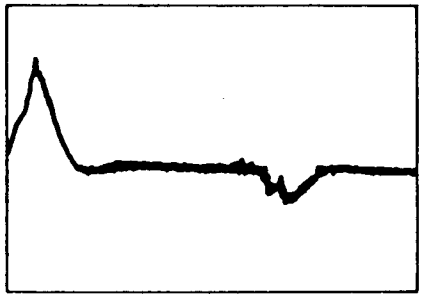
FIG. 11 comprises diagrams showing an advantage of the present invention with regard to the pressure fluctuation, in comparison with the prior art.
Figure 11:
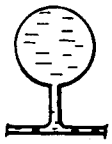
Figure 11:
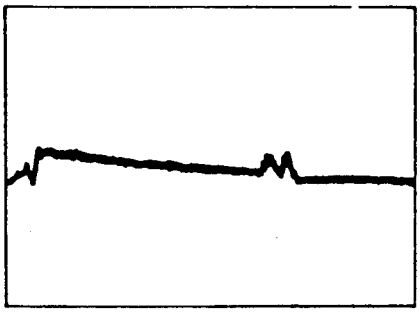
Figure 11:
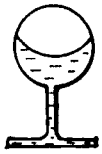
Figure 11:
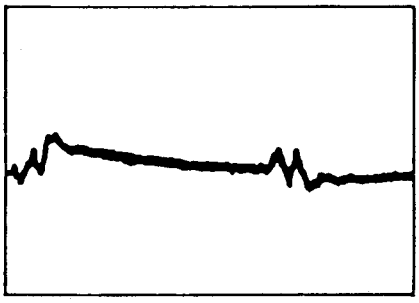

FIG. 11 shows experimental results of pressure fluctuations when the pressure damper according to the present invention is used, in comparison with the prior art. In FIG. 11, (A) shows a pressure fluctuation at the inlet port of the ink jet head 4 to which the ink feed tube 4 was connected, wherein the ink tank 2 was directly connected to the ink jet head 4 without the pressure damper, for reference. As can be seen therein, when no pressure damper is provided, there was a relatively large pressure fluctuation. (B) and (C) both shown pressure fluctuations at the inlet port of the ink jet head 4, wherein the pressure damper 56 was provided between the ink tank 2 and the ink jet head 4. In (B), the pressure absorbing chamber 86 was fully filled with the ink without a bubble therein, according to the present invention, whereas in (C), the pressure absorbing chamber 86 was partly filled with the ink with a bubble in the upper portion thereof, according to the prior art.

As can be seen from FIG. 11 (B) and (C), the pressure was $+25$ mm$H_2O$ $-10$ mm$H_2O$ and about $+38$ mm$H_2O$ $-23$ mm$H_2O$, according to the present invention and the prior art, respectively. Namely, the absence of bubbles contributes to a remarkable lowering of pressure fluctuations. In particular, the pressure fluctuation in the negative pressure direction is more serious, because a failure to eject an ink from the associated jet nozzles is mainly due to the negative pressure, which causes the ink to be sucked into the associated nozzles. It was experimentally confirmed that, when A-4 size papers were continuously printed by the ink jet printer having the pressure dampers corresponding to FIG. 11 (B) and (C), about 0.3 and 3.3 ink ejection failures per 1000 papers occurred, respectively.

We claim:

1. A pressure damper of an ink jet printer provided in an ink feed line between an ink jet head and an ink tank to absorb pressure fluctuations in the ink feed line, said pressure damper comprising:

a damper body provided with a pressure absorbing chamber; and a filter incorporated in the damper body directly below the pressure absorbing chamber to filter the ink wherein said ink jet head has a dummy nozzle to which the pressure absorbing chamber is connected at an upper portion of the pressure damper to discharge bubbles trapped by the filter.

2. A pressure damper of an ink jet printer according to claim 1, wherein at least one of the filter and the damper body is made of a material which can be melted when heated.

3. A pressure damper of an ink jet printer according to claim 2, wherein the filter and the damper body are secured to each other by melting the material by heat.

4. An ink jet printer comprising:

an ink tank containing ink;

an ink jet head having ink jet nozzles for ejecting the ink, a dummy nozzle, and an ink feed tube connecting the tank jet head to the ink tank; and a pressure damper provided in the ink feed tube between the ink tank and the ink jet head to absorb pressure fluctuations in the ink feed line, said pressure damper includes a damper body provided with a pressure absorbing chamber, said pressure absorbing chamber connected to the dummy nozzle at an upper portion of the pressure damper to discharge bubbles;

a filter incorporated in the damper body to filter the ink and to trap said bubbles; and a bubble discharge passage for connecting the pressure absorbing chamber to the dummy nozzle.

5. An ink jet printer according to claim 4 further comprising a movable head carriage which supports the ink jet head.

6. An ink jet printer according to claim 4 wherein said filter is provided in the ink feed line downstream of the pressure absorbing chamber.

7. An ink jet printer according to claim 6, wherein the filter is located directly below the pressure absorbing chamber.

8. An ink jet printer according to claim 6, wherein said filter is provided in the pressure absorbing chamber.

9. An ink jet printer according to claim 6, wherein said pressure damper is formed integrally with the ink jet head.

10. A pressure damper of an ink jet printer provided in an ink feed line between an ink jet head and an ink tank to absorb pressure fluctuations in the ink feed line, said pressure damper comprising:

a damper body provided with a pressure absorbing chamber, said pressure absorbing chamber having a first pressure absorbing portion on an upstream side thereof, a second pressure absorbing portion on a downstream side thereof, and a connecting passage connecting said first and second pressure absorbing portions;

a filter incorporated in the damper body to filter the ink, said filter provided between the first and second pressure absorbing portions; and flexible films defining the pressure absorbing chamber, wherein said ink jet head has a dummy nozzle to which the first pressure absorbing portion is connected at the upper portion of the pressure damper to discharge bubbles trapped by the filter.

11. A pressure damper of an ink jet printer according to claim 10, further comprising a bubble discharge passage for connecting the first pressure absorbing portion to the dummy nozzle.

12. A pressure damper of an ink jet printer provided in an ink feed line between an ink jet head and an ink tank to adsorb pressure fluctuations in the ink feed line, said pressure damper comprising:

a damper body provided with a pressure absorbing chamber; and a filter incorporated in the damper body to filter the ink, said filter secured to the damper body to be substantially flush with a wall portion of the damper body that defines the ink feed line in a vicinity of the filter, wherein said pressure damper is formed integrally with the ink jet head.

13. A pressure damper of an ink jet printer according to claim 12, wherein at least one of the filter and the damper body is made of a material which can be dissolved by an organic solvent.

14. A pressure damper of an ink jet printer according to claim 13, wherein the filter and the damper body are secured to each other by dissolving the material by an organic solvent.

15. A pressure damper of an ink jet printer according to claim 12, wherein, when the filter is secured to the damper body, the filter is substantially flush with the wall portion of the damper body that defines the ink feed line in the vicinity of the filter.

16. A pressure damper of an ink jet printer provided in an ink feed line between an ink jet head and an ink tank to absorb pressure fluctuations in the ink feed line, said pressure damper comprising:

a damper body provided with a pressure absorbing chamber, said pressure absorbing chamber having a first pressure absorbing portion on an upstream side thereof, a second pressure absorbing portion on a downstream side thereof, and a connecting passage connecting said first and second pressure absorbing portions;

a filter incorporated in the damper body to filter the ink;

flexible films defining the pressure absorbing chamber;

an ink outlet passage connecting the second pressure absorbing portion to the ink jet head, so that the filter is provided in the ink outlet passage; and a bypass passage connecting the ink outlet passage and the pressure absorbing chamber, said bypass passage extends between the ink outlet passage below the filter and a bottom of the first pressure absorbing portion.

* * * * *